United States Patent [19]

Rendall

[11] Patent Number: 4,875,998

[45] Date of Patent: Oct. 24, 1989

[54] HOT WATER BITUMEN EXTRACTION PROCESS

[75] Inventor: John S. Rendall, Albuquerque, N. Mex.

[73] Assignee: Solv-Ex Corporation, Albuquerque, N. Mex.

[21] Appl. No.: 157,489

[22] Filed: Feb. 18, 1988

Related U.S. Application Data

[63] Continuation-in-part of Ser. No. 930,018, Nov. 7, 1986, abandoned, which is a continuation of Ser. No. 757,677, Jul. 22, 1985, abandoned.

[51] Int. Cl.[4] ..... C10G 1/00

[52] U.S. Cl. ..... 208/390; 208/87; 208/89

[58] Field of Search ..... 208/390, 87, 88, 96, 208/97, 107, 145, 41, 49, 86, 89, 92, 94, 142, 309

[56] References Cited

U.S. PATENT DOCUMENTS

| | | | |
|---|---|---|---|
| 3,725,245 | 4/1973 | Woodle | 208/86 |
| 4,405,446 | 9/1983 | Kluyer | 208/390 |
| 4,460,452 | 7/1984 | Johnson et al. | 208/390 |

FOREIGN PATENT DOCUMENTS

| | | | |
|---|---|---|---|
| 1527269 | 10/1978 | United Kingdom | 208/390 |
| 8402145 | 6/1984 | World Int. Prop. O. | 208/390 |

*Primary Examiner*—H. M. Sneed
*Assistant Examiner*—Chung K. Pak
*Attorney, Agent, or Firm*—Thomas E. Schatzel

[57] ABSTRACT

A method and apparatus for a combined solvent and hot water extraction of bitumen oils from tar-sands ore. The crushed tar-sands ore is conditioned in hot water while excluding air, after which oversized and inert rocks are removed by screening. The bitumen content of the resulting slurry is then extracted with a water immisible hydrocarbon solvent of low density to form a solution of bitumen oils in solvent or bitumen extract phase, a middle water phase and a lower spent wet solids phase. Each of these phases is thereafter processed to produce product bitumen oils and to recover solvent and water for reuse within the process. The product bitumen oils are further processed to separate the fines, and may be refined and separated into synthetic crude oil and asphaltenes residue components. The asphaltenes residue component may be burned in a fluidized bed boiler to provide process heat and electrical power for the method.

15 Claims, 8 Drawing Sheets

HOT WATER BITUMEN EXTRACTION PROCESS

Cross Reference to Related Applications

This is a continuation-in-part of application Ser. No. 06/930,018, filed Nov. 7, 1986, now abandoned, which is a continuation of application Ser. No. 06/757,677, filed July 22, 1985, now abandoned.

BACKGROUND OF THE INVENTION

1. Field of the Invention

This invention relates to a hot water extraction process for removing bitumen oils from tar-sands ore and more particularly to a process combining solvent and hot water extraction with air exclusion. The tar-sands ore is conditioned in hot water and then extracted with a water immiscible hydrocarbon solvent to form a mixture which settles into several phases. Each of these phases is thereafter processed to produce product bitumen oils and recycled process components.

2. Description of the Prior Art

A wide range of processes have been proposed for the extraction of bitumen from the surface-mined tar-sands ore. Of chief importance in developing and implementing a technique is the commercial viability and the ecological compatibility of the technique. Extraction techniques may be broken down into two major categories, those which employ water, either hot or cold, to float the bitumen oils away from the tar-sands, and those which employ an organic solvent to dissolve the bitumen oils. The processes utilizing water often involve air floatation, and often require addition of an alkaline material The water processes are not efficient, particularly on the lower bitumen content ore due to the formation of stable emulsions containing fine tar-sands ore particles, water and bitumen oils. The treatment of emulsions of large volumes of water containing bitumen oils and fine tar-sands ore particles has proven to be difficult.

Solvent processes without water are under development and typically follow the practices of the oil seed extraction technologies. Percolation and immersion-type extractors have been used, but the special designs and scale-up for abrasive tar-sands processing may be difficult. The solvent to bitumen ratio to be used for efficient extraction is often high, up to ten to one, which indicates high capital and utilities cost for the distillation recovery of the solvent. Spent sands have to be stripped of residual solvent, which is capital and energy intensive, before disposal for economic solvent usage. Existing methods using solvents to dissolve the bitumen oils from tar-sands, for example, as disclosed in U.S. Pat. No. 4,160,718, issued to Rendall, typically exhibit environmentally unacceptable losses of solvent, and have problems associated with hazards posed by the storage of large solvent inventories and require large quantities of water. Other solvent or hot water extraction processes or combinations are disclosed in U.S. Pat. Nos. 4,347,118, issued to Funk, et al. and 3,925,189, issued to Wicks, III. All of these methods, however, suffer commercial or ecological drawbacks, rendering them undesirable. A method for solvent and hot water extraction of bitumen from tar-sands is the subject of U.S. Pat. No. 4,424,112, issued to Rendall. This process however, requires numerous pieces of specialized equipment and is not highly energy efficient. The process is also adapted for a particular type of tar-sands found at Santa Rosa, N.M.

SUMMARY OF THE PRESENT INVENTION

An object of the present invention is to provide a method for the extraction of bitumen oils from tar-sands ore which is also commercially practical.

Another object o the present invention is to provide a method for the extraction of bitumen oils from tar-sands ore which is ecologically sound.

Another object of the present invention is to provide a method for the extraction of bitumen oils from tar-sands ore which may be easily scaled-up to commercial size.

Another object of the present invention is to provide a process for the production of synthetic crude oil from low grade tar-sands ore.

Another object of the present invention is to provide a method for the extraction of bitumen oils from tar-sands ore which results in a high yield of bitumen oils.

Another object of the present invention is to provide a method for the extraction of bitumen oils from tar-sands ore which removes substantially all fine sand and clay particles and asphaltenes residue from the bitumen oils resulting in a highly pure product.

Another object of the present invention is to provide a process for the extraction of bitumen oils from tar-sands ore which can supply its own process heat and steam.

Another object of the present invention is to provide an extraction process requiring a low ratio of process water usage to product bitumen oils.

Briefly, a preferred embodiment of the present invention is a process combining both solvent extraction and hot water extraction without air floatation. Tar-sands ore is first crushed in a conditioning step to a maximum ore size suitable for further conditioning by utilizing rotating mechanical augers to break down the tar-sands ore conglomerate, producing conditioned small particles, hereinafter called tar-sands, by attrition while mixing in hot water and excluding air. The conditioned tar-sands and water slurry is then screened to remove oversized and inert rocks, in the event the crushed ore size requires screening. The bitumen oils are then extracted by a water immiscible hydrocarbon solvent, hereinafter called solvent, in two countercurrent mixer-settler stages, producing an extract phase of bitumen oils and solvent, hereinafter referred to as a bitumen extract, and a solids phase. The solvent is recovered from the bitumen extract by distillation. A fines removal step, comprising centrifugation for example, wherein fine sand and clay particles, hereinafter called fines, are removed may preceed the solvent recovery step and allow for an intermediate asphalt product in situations where asphalt production is desired. The refining process comprises hydrovisbreaking with or without a catalyst addition, and alternatives include treatments utilizing a fluidized catalytic cracker or subcritical and supercritical solvent extraction techniques. The asphaltenes residue extracted from the bitumen oils can be burned to produce power and heat for the facility. Spent sand with water and fines from the mixer-settler stages, is washed and dehydrated for disposal. Water containing fines is clarified with the addition of a flocculant, and the solid materials are precipitated while the liquids are recovered and recycled.

A preferred embodiment of the apparatus of the present invention includes a tar-sands ore crushing device and log washer conditioner to condition the crushed tar-sands by dislodging bitumen oils from the solid particles of the slurry. The extraction apparatus utilizes two cylindro-conical soak vessels, each of which is paired with a sand separation vessel which may incorporate a mechanical rake to facilitate removal and agitation of the sand. The spent solids are washed using two countercurrent sand washers which are inclined screw conveyors with provisions for injecting an up-flow of wash water. Fines in the water phase are settled out of suspension in a thickener-settler with the aid of a flocculant. Spent solids and fines are dehydrated using a sand dehydrator, also comprising an inclined screw conveyor, and a fines centrifuge. Solvent washed from the spent sand is recovered, separated and recycled using distillation columns and condensers.

An advantage of the present invention is that bitumen oils are extracted in a commercially and economically viable manner.

Another advantage of the present invention is that a high percentage of the bitumen oils contained in the tar-sands ore is extracted.

Another advantage of the method of the present invention is that synthetic crude oils are produced which are substantially pure and free from fines and asphaltenes residue.

Another advantage of the method of the present invention is that emulsions of fines, water and bitumen oils with air are almost entirely eliminated.

Another advantage of the method of the present invention is that process components and energy are recovered and reused.

Another advantage of the present invention is that the ratio of water consumed to bitumen oils produced is very low.

Another advantage of the method of the present invention is that low grade tar-sands ore can be effectively processed.

Another advantage of the method of the present invention is that the process steps are generally low temperature and atmospheric pressure operations utilizing conventional equipment available in large capacity units.

These and other objects and advantages of the present invention will no doubt become obvious to those of ordinary skill in the art after having read the following detailed description of the preferred embodiments as illustrated in the various drawing figures.

DETAILED DESCRIPTION OF THE PREFERRED EMBODIMENT

Figure 1:
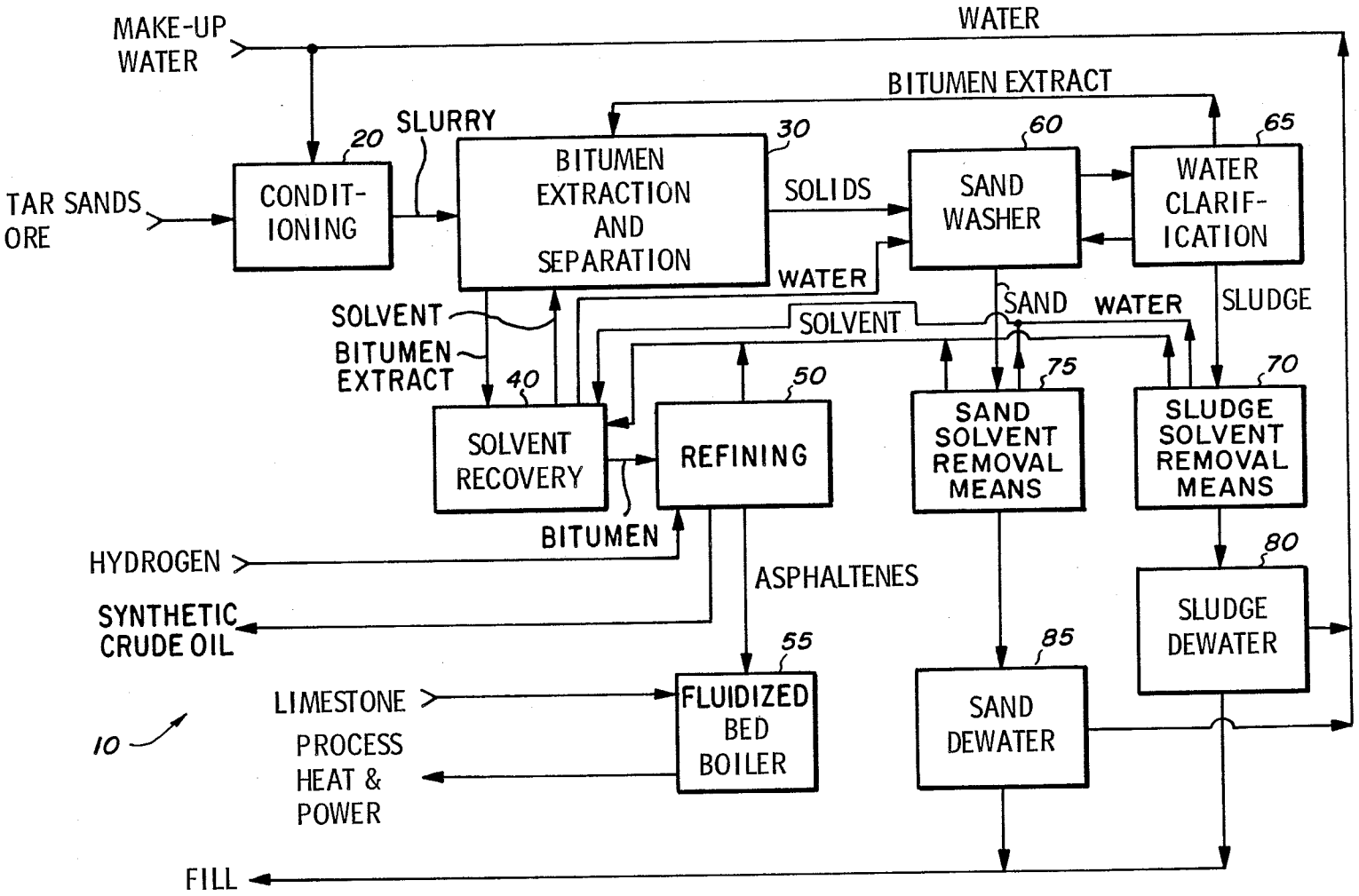
FIG. 1 is an overall block diagram of the method for extracting bitumen oils from tar-sands ore in accordance with a preferred embodiment of the present invention.

FIG. 1 is a block diagram illustrating the overall process 10 by which bitumen oils are extracted from tar-sands ore and processed for use as refinery feed stock. The following description of the invention relates to the process as particularly adapted to extract bitumen oils from tar-sands ores similar in composition to those found at P.R. Springs, Utah or Athabasca, Canada.

The process for extraction of bitumen oils from tar-sands ore begins with the introduction of tar-sands ore from the mine and hot water into a tar-sands ore conditioning means 20. Within the tar-sands ore conditioning means 20, the tar-sands ore is crushed down to a maximum size required by a commercial scale log washer conditioner wherein the crushed tar-sands ore is further broken down utilizing mechanical crushing and agitation means and slurried with hot water. By excluding air from the tar-sands ore conditioning means 20, the tar-sands ore and hot water are formed into a slurry, comprising sand, bitumen oils, hot water and fines, hereinafter called slurry, which is essentially free of both consolidated pieces of tar-sands and emulsions of fines, water, bitumen oils and air. The slurry formed by mixing the tar-sands with hot water leaves the tar-sands ore conditioning means 20 and enters a bitumen extraction and separation means 30.

The bitumen extraction and separation means 30 accepts the slurry from the tar-sands ore conditioning means 20. The bitumen extraction and separation means 30 includes inputs for slurry and solvent and separates the slurry into two streams. Extracted bitumen oils and any solids and associated water removed with the bitumen extract exit the bitumen extraction and separation means 30 and enter a solvent recovery means 40 which utilizes steam stripping and atmospheric distillation to separate a mixture of solvent and any associated water from the bitumen oils. This mixture is subsequently separated by gravity separation into individual components of solvent and water. The solvent recovered in the solvent recovery means 40 leaves the means 40 and is returned to the bitumen extraction and separation means 30. The bitumen oils leaving the solvent recovery means 40 are refined in the refining means 50 by a hydrovisbreaking process which reacts the bitumen oils with hydrogen at elevated temperatures and pressures, and may be with or without catalyst addition. Fines may be removed from the residue from the refining means 50 in a fluidized bed boiler means 55. The end product of the process 10 is a synthetic crude oil.

Extracted wet solids from the bitumen extraction and separation means 30 enter a sand washing means 60 wherein the solids, comprising primarily sands and fines, are washed with water to recover any remaining solvent plus associated bitumen oils as a bitumen extract phase. The wash water, containing fines and extract phase, exits the sand washing means 60 is fed to a water clarification means 65 wherein fines from the sand washing means 60 are concentrated and removed. The water clarification means 65 utilizes a thickening and settling means to separate the wash water into streams of clarified water, extract phase and fines sludge. The fines sludge, hereinafter called sludge, is comprised mainly of fines and water with some associated solvent. The extract phase is recycled to the bitumen extraction and separation means 30 and the clarified water stream is recycled to the sand washing means 60. The sludge stream from the clarification means 65 enters a sludge solvent removal means 70. The sludge solvent removal means 70 strips the sludge in a steam distillation column to recover solvent with some water as a vapor.

A sand solvent removal means 75 receives a flow of washed sand from the sand washing means 60 and also utilizes a steam distillation column to strip solvent off with some water as a vapor. The streams of solvent and water vapor from the sand solvent removal means 75 and the sludge solvent removal means 70 are condensed and separated. The solvent is returned to the solvent recovery means 40 and the water is returned to the sand washing means 60.

Sludge, from which solvent has been stripped, exits the means 70 and is reduced in water content for disposal in a sludge dewatering means 80. Similarly, sand which has been stripped of solvent in means 75 enters a sand dewatering means 85 wherein the sand residue is reduced in water content for disposal. Water extracted from both the sludge and the sand is combined and recycled to the tar-sands ore conditioning means 20 to again contact tar-sands ore to form a slurry.

A process for the extraction of bitumen oils from tar-sands ore is assembled from these processing means as follows. Tar-sands ore from the mine is fed into the tar-sands ore conditioning means 20 at a maximum size suitable for the conditioning means 20. The tar-sands ore conditioning means 20 also accepts a flow of hot water. Within the tar-sands ore conditioning means 20, the tar-sands ore is crushed and further conditioned with hot water and is formed into a slurry containing sand, fines, bitumen oils and water, which is essentially free of both consolidated pieces of tar-sands and emulsions of fines, water and bitumen oils with air. The slurry is formed by means of intermixing of the constituents within the tar-sands ore conditioning means 20. The slurry exits the tar-sands ore conditioning means 20 and enters the bitumen extraction and separation means 30, wherein bitumen oils are loosened from the solids within the slurry by mixing and by solvent extraction with the exclusion of air. Within the separation means 30, the slurry is contacted with some bitumen extract, agitated and settled. Once the bitumen oils are softened or dislodged, from the solid particles within the slurry, a bitumen extract comprising solvent plus bitumen oils with some fines and water is drawn off and introduced into the solvent recovery means 40.

In the solvent recovery means 40, the bitumen extract is separated into a stream of solvent plus water, and a stream of bitumen oils and a trace of fines by solvent flashing and atmospheric stripping. The water and solvent mixture is further separated according to density, and recycled. The resulting bitumen oils stream exit the solvent recovery means 40 and enters the refining means 50. A number of processes may be employed within the refining means 50 to hydrogenate and/or remove fines and asphaltenes residue from the bitumen oils. These include an asphalt residual treatment utilizing a fluidized catalytic cracker, solvent extraction at, above, or below supercritical conditions and hydrovisbreaking, with or without catalyst and with or without solvent deasphaltizing. In the process 10, the refining means 50 utilizes a hydrovisbreaking method. Refined synthetic crude oil exits the means 50 as the primary product of the process 10, and asphaltenes residue plus extracted fines enter the fluidized bed boiler means 55. Within the fluidized bed boiler means 55, the asphaltenes residue can be burned to provide process heat and power and the fines are removed in a bag house, or wet scrubber.

Wet sand and fines exiting the bitumen extraction and separation means 30 enters the sand washing means 60 wherein the sand is washed with water to carry off any entrained bitumen extract. The water and bitumen extract under flow containing some fines from the solids washing means 60 is thickened and settled in the clarification means 65. Clarified water is then drawn off from the clarification means 65 and recycled, and a stream of bitumen extract plus a trace of fines is reintroduced into the bitumen extraction and separation means 30. Also emerging from the clarification means 65 is a sludge stream containing the fines with some solvent and water. The sludge stream from the clarification means 65 enters the sludge solvent removal means 70 wherein the sludge is steam stripped at or below atmospheric pressure, to flash off entrained solvent. The flow of washed sand exiting the sand washing means 60 is also steam stripped of solvent, at or below atmospheric pressure, in a stripping column within the solvent removal means 75. The stripped solvent plus steam emerging from the solvent removal means 70 and 75 is combined and recycled to the solvent recovery means 40. Stripped sludge is reduced in water content within the sludge dewatering means 80 to about thirty percent in a centrifuge. Stripped sand is reduced in water content to about twenty percent in a sand dehydrator within the sand dewatering means 85. Water removed within the means 80 and 85 is combined and recycled to the conditioning means 20. The dewatered sand and sludge may be used as fill.

Separation of the bitumen extract from the other components of the slurry in the bitumen extraction and separation means 30 can be easily performed for any bitumen extract having a specific gravity of less than one. However, bitumen extracts having lower specific gravities are more easily separated than those having higher specific gravities because of the lower density of bitumen extracts with lower specific gravity solvents. Thus, almost any light hydrocarbon with a specific gravity of less than nine tenths (0.9) applied to the crushed tar-sands and hot water slurry will produce a bitumen extract capable of being separated. Separation of the solvent from the bitumen extract in the solvent recovery means 40 can be performed for a wide range of light hydrocarbons having specific gravities of less than 0.9. However, solvent recycling will be facilitated if the solvent chosen is one of the constituents of the bitumen oils extracted from the tar-sands. By choosing such a solvent, a make-up solvent supply required for the extraction of the bitumen oils can be supplied as a light fraction of the extracted bitumen oils. Such solvents include any of the light cuts of the bitumen extract including naphtha, kerosene, and toluene.

Toluene is the preferred hydrocarbon for use as a solvent in the extraction of tar-sands found in a variety of matrix compositions such as those in the P.R. Springs region of Utah. Toluene has a specific gravity of approximately 0.866 at 60° F., is a component of the native bitumen oils of the tar-sands ores and it forms an azeotrope with water and thus, can be easily separated from the bitumen oils.

Figure 2:
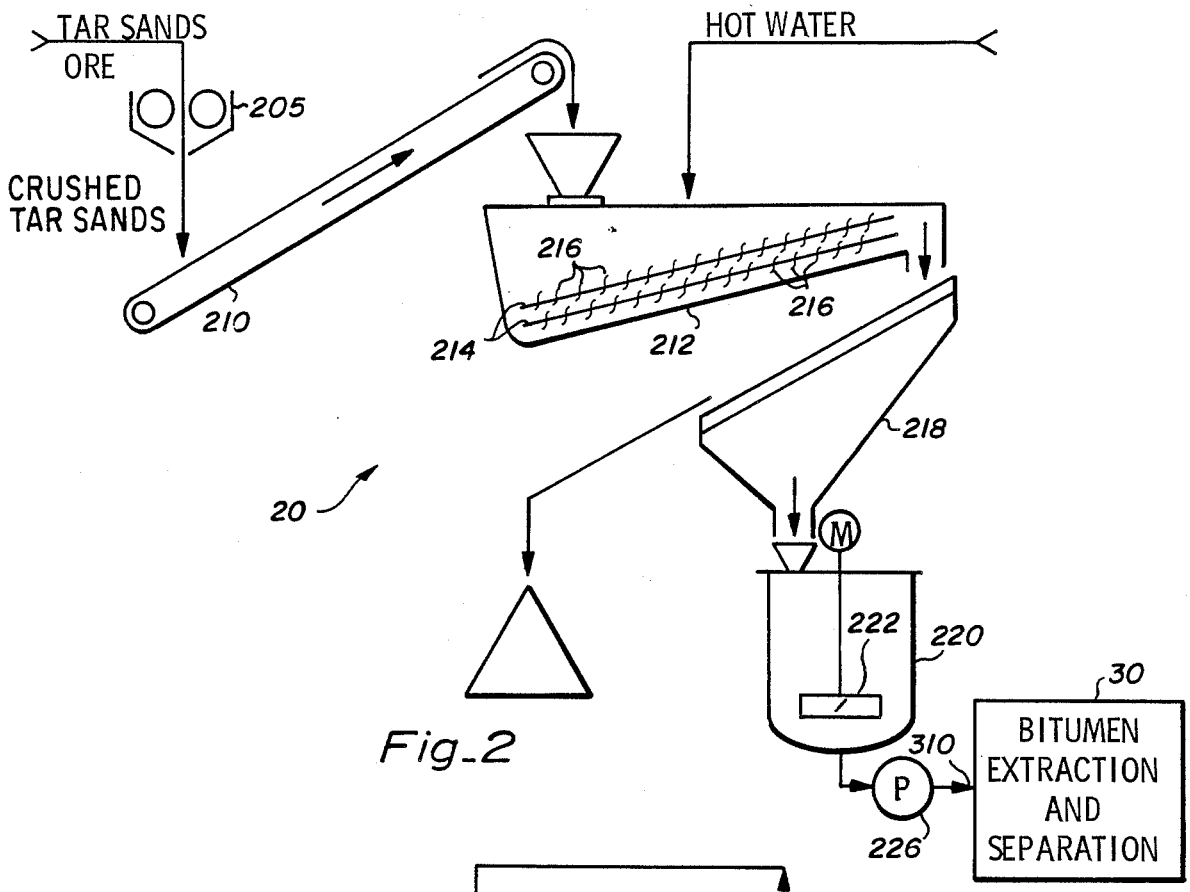
FIG. 2 is a diagram showing a detailed schematic implementation of the conditioning step of the method of FIG. 1.

A detailed implementation of the tar-sands ore conditioning means 20 is illustrated in FIG. 2. The conditioning means 20 employs a crushing device 205 suitable for the characteristics of the tar-sands ore to be crushed and a feed conveyor 210 for receiving crushed ore which has been crushed to the maximum size range suitable for feed into a commercially sized log washer conditioner. The crushing device 205 delivers the crushed tar-sands ore to the conveyor 210, which delivers the ore to a log washer conditioner 212. Simultaneously, hot water is introduced into the log washer conditioner 212. The amount of hot water added is sufficient to substantially fill the log washer conditioner 212 such that air is excluded from the resulting tar-sands and hot water slurry to eliminate emulsions which can aversely effect separation. In some circumstances, e.g., in very cold environments, a supply of condensing steam is also delivered to the log washer conditioner 212 to maintain the desired water temperature. The log washer conditioner 212 is an enclosed vessel having an inclined bottom, and contains a pair of shafts 214, each of which includes a plurality of paddles 216. The shafts 214 operate in a counter-rotating fashion to abraid the submerged tar-sands to further condition the tar-sands and facilitate solvation of the bitumen oils associated therewith. The paddles 216 are attached to shafts 214 at an angle of between 25° forward to about 15° backward, depending on the type of tar-sands ore deposit. This angle dictates the energy input necessary to break the ore into sufficiently small particles to form a suitable slurry and to promote separation of the bitumen oils. The angles are chosen to provide the necessary attrition for each ore type with a minimum of input energy. Oil wet tar-sands ores such as those found at P.R. Springs, require a greater amount of attrition, therefore a combination of backward and forward angles is selected. Water wet tar-sands ore, such as those found at Athabasca, Canada, need less attrition and a forward angle can be used. Conditioned tar-sands exit the log washer conditioner 212 and fall onto a screen 218 where oversized and inert rocks, which do not condition, are screened out. The screened out rocks fall out of the screen 218 to be crushed and returned to the log washer conditioner 212, or used for fill, or burned to provide process heat and power, depending on the size and bitumen content of the rocks. The conditioned slurry falls through the screen 218 and into a slurrying tank 220. Within the slurrying tank 220, the slurry is mixed under the influence of a mechanical mixing means, for example, a rotating paddle 222 to further loosen the bitumen oils from the tar-sands. The paddle 222 also acts to keep the solids in suspension. The slurry, comprising water, sand, fines, and bitumen oils exits the bottom of the slurrying tank 220 and is transferred to the bitumen extraction and separation means 30. Motive force to pump the slurry is supplied by a pump 226 which, in the embodiment 10 is a centrifugal type pump, although other types of pumps may serve equally well. Bitumen oils, water, sand and fines slurry exit the conditioning means 20 upon their exit from the pump 226.

Figure 3:
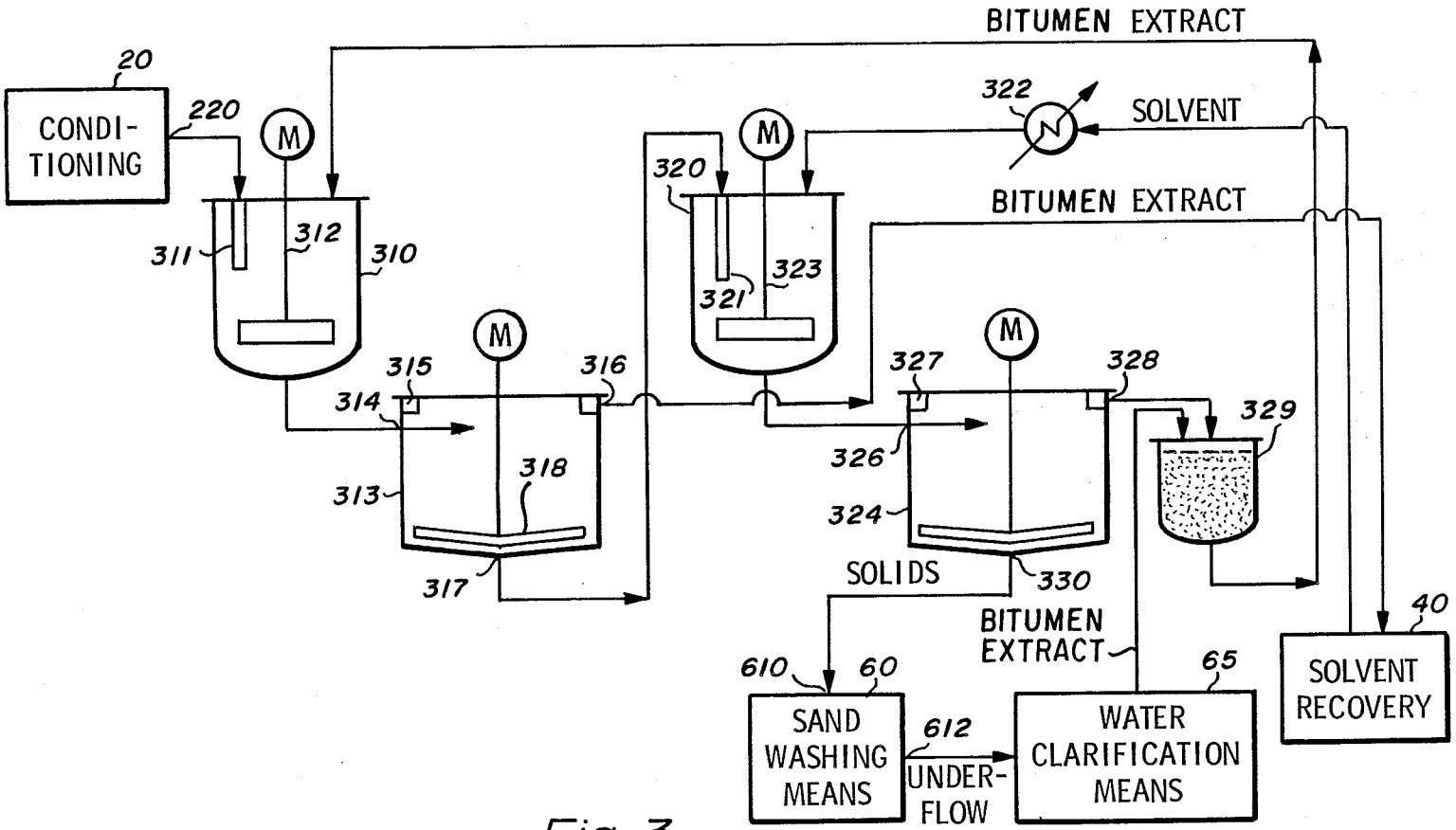
FIG. 3 is a diagram showing a detailed schematic implementation of the bitumen extraction and separation step of FIG. 1.

Slurry from the pump 226 enters the bitumen extraction and separation means 30 illustrated in the schematic in FIG. 3, at a first soak vessel 310. The soak vessel 310 receives the slurry, and a flow of bitumen extract comprising a mixture of solvent and bitumen oils. The slurry enters the vessel 310 via a dip pipe 311, below the surface of the liquid in the vessel 310. Within the soak vessel 310, the bitumen extract solvates the loosened bitumen oils of the slurry and this process is aided by a mechanical mixer 312. After a residence time of up to about twenty minutes, depending on the source of the tar-sands, the slurry exits the bottom of the vessel 310 and is introduced into a first sand separator 313 at a slurry input 314 which is positioned in the center near the upper two-thirds level of the separator 313. The separator 313 includes a circumferential overflow weir 315 positioned above the input 314 and an extract outlet 316 fitted external to the weir 315. The separator 313 has a wet solids outlet 317 formed to the bottom thereof for removing the wet solid particles from the slurry. These wet solid particles, hereinafter called wet solids, are comprised of sand, entrained bitumen extract, water and some fines and bitumen oils. The sand separator vessel 313 includes a mechanical rake 318 in the interior which may be utilized to agitate and stir the slurry to promote separation of the bitumen extract from the remaining components of the slurry. The bitumen extract outlet 316 is near to the top of the separator 313 to take advantage of the lower density of the bitumen extract which rises to the top of the separator 313.

Wet solids, exiting the separator 313 via wet solids outlet 317 are pumped to a second soak vessel 320 which is similar in structure and function to the first soak vessel 310. The vessel 320 receives the wet solids from the sand separator 313, via a dip pipe 321 and also receives a flow of solvent from the solvent recovery means 40. The solvent from the solvent recovery means 40 is heated in a heat exchanger 322 wherein the temperature is maintained to be below the boiling point of the solvent chosen and in the case of toluene, to just below 180° F., prior to the solvents entry into the vessel 320. The vessel 320 mixes the components with an internal mechanical mixer 323. Sands, fines, water and bitumen extract exit the second soak vessel 320 and are introduced into a second sand separator 324, which also is similar in structure and function to the first sand separator 313, via a first inlet 326 positioned in the center, near the upper two-thirds level of the separator vessel 324.

The separator 324 includes a circumferential overflow weir 327 and an extract outlet 328, fitted external to the weir 327 to allow the lighter bitumen extract, comprising some bitumen plus solvent and fines to be drawn off. The bitumen extract drawn off at the extract outlet 328 is delivered to a buffer tank 329, and is then returned to the first soak vessel 310 to combine with slurry therein. The second sand separator 324 also has a wet solids outlet 330 through which wet solids, leave the bitumen extraction and separation means 30 and enter the sand washing means 60. Bitumen extract leaves the first sand separator 314 via the extract outlet 316 and accordingly, exits the bitumen extraction and separation means 30 to be introduced to the solvent recovery means 40. It should be noted that the bitumen extraction and separation means 30 may utilize a number of types of apparatus to achieve a countercurrent, slurry-solvent flow. For example, Graesser contactors or inclined screw conveyors may also be employed.

Figure 4:
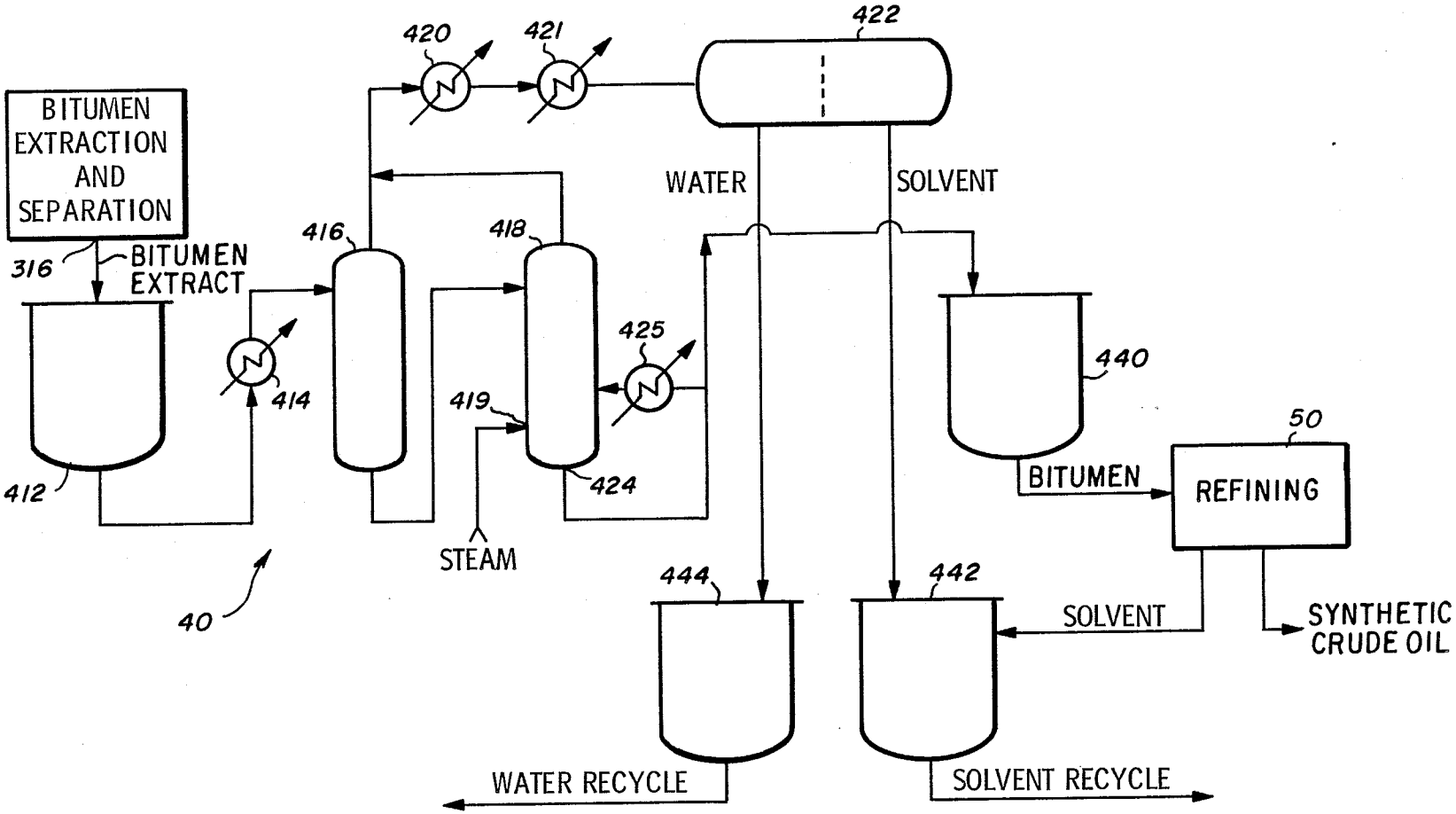
FIG. 4 is a diagram showing a detailed schematic implementation of the solvent recovery step of FIG. 1.

The solvent recovery means is illustrated in FIG. 4 and includes a distillation feed tank 412 for receiving extract from the outlet 316 of the bitumen extraction and separation means 30. From the feed tank 412, the bitumen extract is pumped through a heat exchanger 414 to a solvent flashing column 416. The heat exchanger 414 utilizes steam to heat the bitumen extract to above the boiling point for the solvent chosen; e.g., in the process 10, the bitumen extract is heated between 250° and approximately 350° F. The solvent flashing column 416 is a conventional atmospheric pressure flash distillation unit, and upon entry of the bitumen extract into the column 416, a portion of the heated solvent flashes off and exits the top of the column 416. Remaining bitumen extract, comprising primarily bitumen oils with some solvent exits the bottom of the flasher 416 and is introduced into a solvent stripper 418. Solvent stripper 418 is a steam vacuum stripping column and also includes a steam input 419 formed near the bottom thereof for inputting steam thereto to effect separation of solvent from bitumen oils. Stripped solvent plus water vapors are carried out the top of the stripper 418 and are combined with solvent flashed off the flashing column 416. The combined mixture is passed through a pair of heat exchangers 420 and 421, to cool the mixture and to simultaneously heat water for use within the tar-sands ore conditioning means 20. The cooled solvent/water mixture is introduced to a distillate decanter 422 where solvent is separated from water according to density.

The stripper 418 includes a bitumen oils product outlet 424 formed to the bottom thereof through which stripped bitumen oils may flow. A bottom portion of the bitumen oils are charged to a heat exchanger 425, heated to above the solvent boiling point, and returned to the stripper 418. The remaining bitumen oils flowing out the outlet 424 are delivered to a bitumen oils buffer tank 440, from which the bitumen oils leave the solvent recovery means 40. Solvent separated from water within the distillate decanter 422 is pumped to a solvent buffer tank 442 and the water is pumped to a water buffer tank 444. The buffer tanks 442 and 444 serve to collect and store solvent and water respectively, from various points within the system 10 for subsequent reuse.

Figure 5:
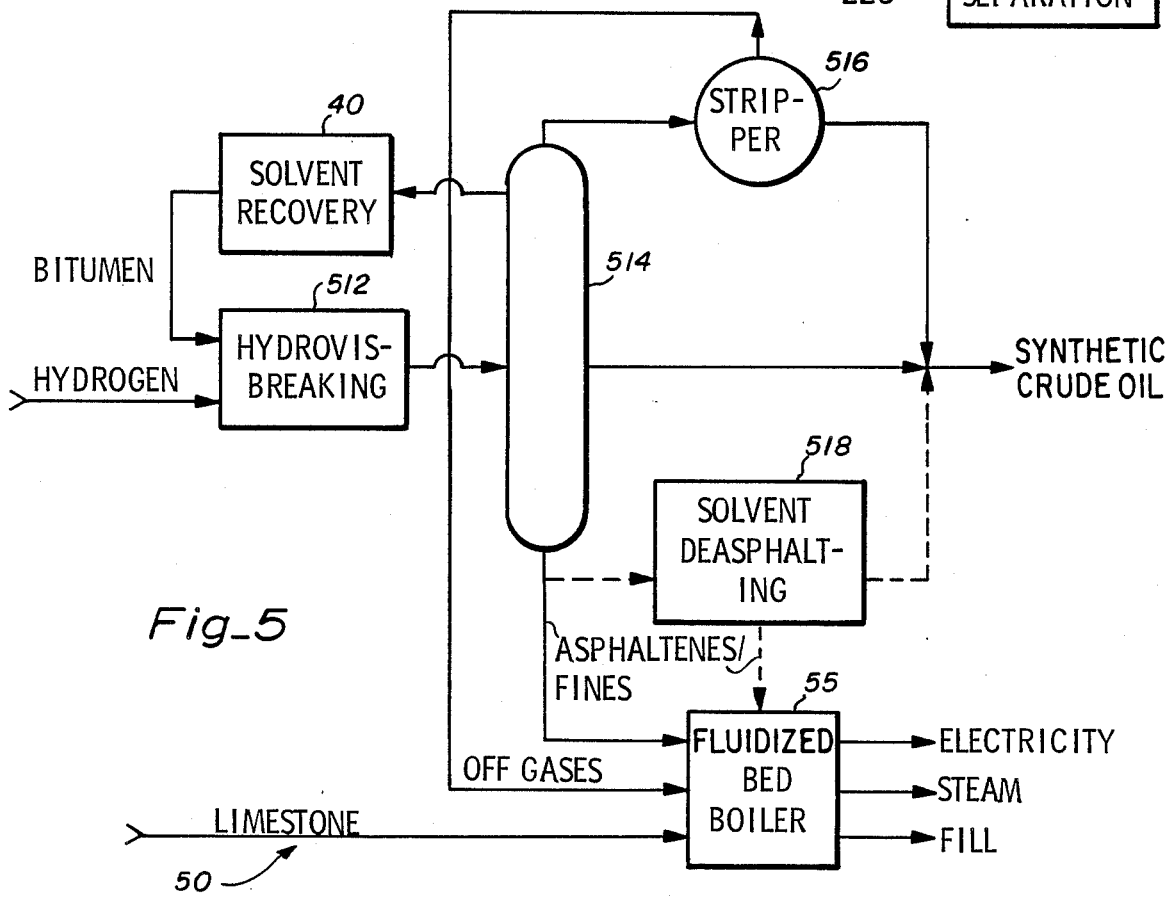
FIG. 5 is a diagram showing a detailed schematic implementation of the refining step of FIG. 1.

The refining means 50 is illustrated in detailed schematic in FIG. 5 and includes a hydrovisbreaking step 512 wherein the bitumen oils from the solvent recovery means 40 are reacted with a flow of hydrogen at pressures in the range of about 600 to 3,000 psig and temperatures between 650° F. and 1000° F. The preferred pressure and temperature are about 1,000 psig and 800° F. to 850° F., respectively, with a residence time of 30 to 90 minutes. The resulting crude oil enters a distillation means 514; e.g., a distillation column, wherein the crude oil is distilled to yield a light fraction, an intermediate synthetic crude oil fraction, and an asphaltenes residue containing fines. A light solvent fraction may also be withdrawn from the distillation means 514 and can be returned to the solvent recovery means 40.

The light fraction from the distillation means 514, is charged to a stripper 516 where off gases are removed, and the remaining hydrocarbons are combined with the intermediate synthetic crude oil fraction to yield a high-grade synthetic crude oil product.

The asphaltenes residue, including fines, is charged to and burned in the fluidized bed boiler means 55 together with a flow of off gases from the stripper 516 and a flow of limestone to neutralize the gases and provide acceptable emission levels while yielding process heat and power. The fines are removed in a bag house or wet scrubber (not shown) associated with the fluidized bed boiler means 55.

An alternative mode of operation of the refining means 50 is to include a solvent deasphaltizing step 518 (connected with dashed lines to the method in FIG. 5) to refine the residue and further increase the yield of synthetic crude oil. In this mode, the hydrovisbreaking step 512 is operated for a shorter period of time; e.g., 10 to 30 minutes, and the solvent deasphaltizing step 518 is employed to remove the asphaltenes residue. The deasphaltizing step may use a number of aliphatic or aromatic light hydrocarbon solvents as is known in the art. Examples of solvents include pentane or hexane, and the deasphaltizing may occur either above or below supercritical conditions for the solvent chosen. Asphaltenes residue plus fines remaining after the oil is extracted enter the fluidized bed boiler means 55 as before.

In crude bitumen oils where fines do not act as a catalyst, it may be necessary to add a catalyst to the hydrovisbreaking means 512. Typical catalysts include vanadium sulphide, zeolites, and liquid catalysts including alkaline metal hydrosulphides. Crude bitumen oils resulting from the catalytic hydrovisbreaking are put into the distillation means 514 and the residue, defined as the 1050+° F. fraction, is fed to the fluidized bed boiler means 55. The remaining fractions from the distillation means 514; i.e., the 1050−° F. fractions, are synthetic crude oil. It may be noted that the hydrovisbreaking implementation of the refining means 50 can successfully refine bitumen oils having a high percentage of fines; e.g., greater than three to four percent.

Figure 6:
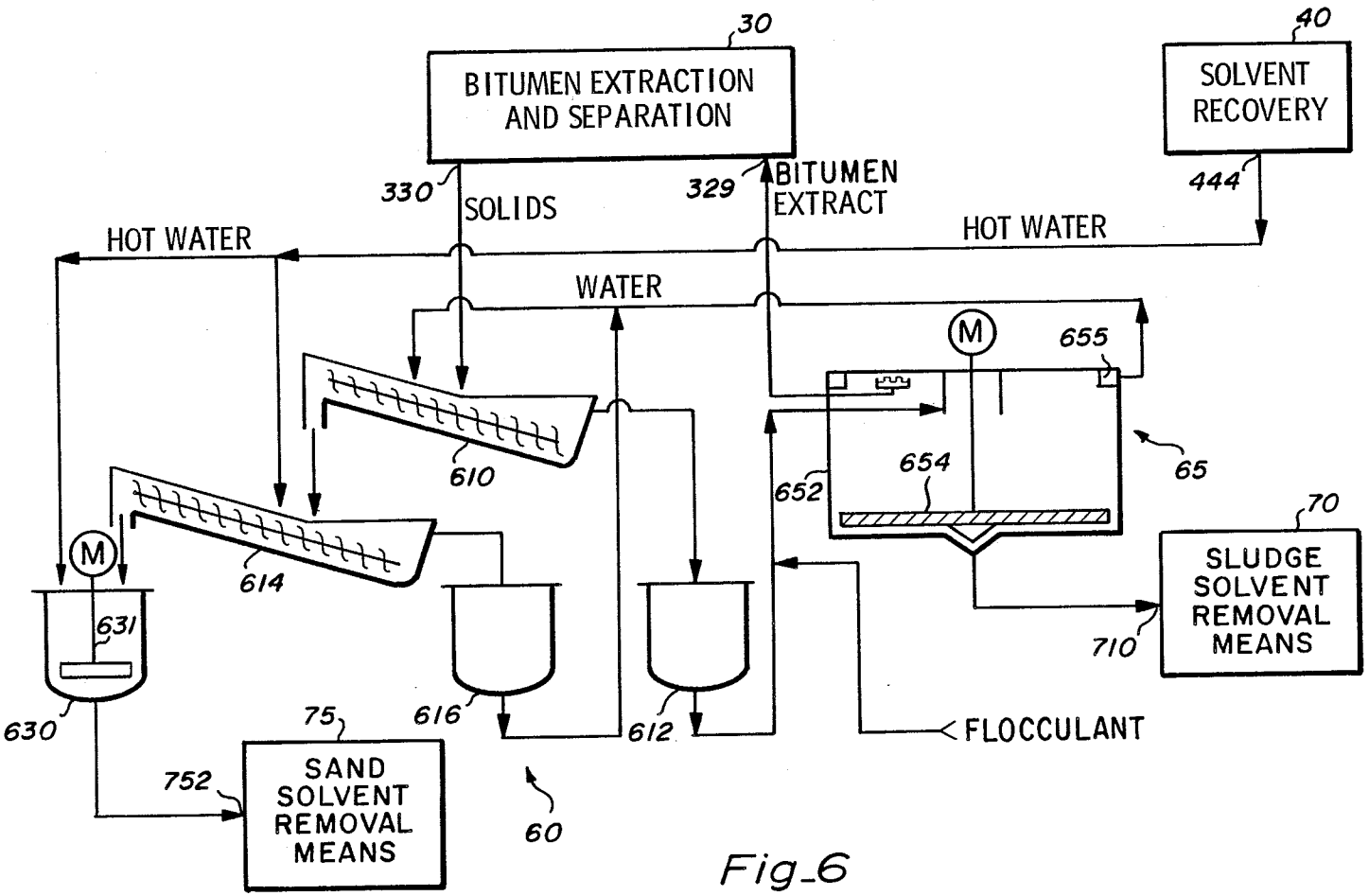
FIG. 6 is a diagram showing a detailed schematic implementation of the sand washing and water clarification steps of FIG. 1.

Wet solids which are separated from the bitumen extract within the bitumen extraction and separation means 30 exit the second sand separator 324 at wet solids outlet 330 and enter the sand washing means 60, illustrated in FIG. 6. A mixture of sand, fines and water containing some entrained bitumen extract leaves the sand separator 324 and flows to a first sand washer 610. The sand washer 610 incorporates a screw classifier to aid in releasing any trapped bitumen extract, including water, fines, solvent and bitumen oils. Essentially, this is an inclined screw conveyor designed to wash the spent sand with an up flow of injected wash water, with the sand being conveyed out of the top of the washer 610 via the screw mechanism. Along with wet solids from the sand separator 324, wash water is introduced into the sand washer 610. Underflow wash water flows by gravity and countercurrent manner to the solids, exits at the lower end of the sand washer 610 and is collected in an under flow receiver 612. Sand and remaining water are conveyed out of the top of the sand washer 610 by the screw mechanism, and enter a second sand washer 614 which is similar to the first sand washer 610. Additional wash water flows into the second sand washer 614 and is collected in a second under flow receiver 616 placed at the lower end of the second sand washer 614. Water collected in the under flow receiver 616 is returned to the first sand washer 610 to serve as part of the required wash water. Washed sand emerging from the top of the second sand washer 614 enters a sand reslurry tank 630, wherein the washed sand is reslurried with clean water from the buffer tank 444. A mechanical stirrer 631 within the tank 630 aids in forming a solids suspension.

Water collected in the first under flow receiver 612, which has flowed through both sand washers 610 and 614 and which carries with it some bitumen extract plus fines, is pumped to a thickener-settler 652 of the water clarification means 65 also illustrated in FIG. 6. The thickener-settler 652 is a tank similar in construction to the sand separators 313 and 324 and aids in effecting a density separation of the components carried in the water. The thickener-settler 652 includes an internal rake 654 to facilitate gravity settling of the components. A flocculant may be added to the contents of the thickener-settler 652 to further aid in separation. Clarified water is drawn from a circumferential over flow weir 655 formed to the top of the thickener-settler 652 and it is returned to the sand washer 610 for reuse. A bitumen extract phase, comprising bitumen oils with solvent plus some water and fines is also removed from the thickener-settler 652 internally, near the top of the liquid phase within the thickener-settler 652 and is returned to the inlet buffer tank 329 of the bitumen extraction and separation means 30. As an alternative, the bitumen extract drawn from the thickener-settler 652 may be delivered to the solvent recovery means 40. The heaviest components, comprising fines, some solvent, water and flocculant, exit the bottom of the thickener-settler 652 and are charged to a sludge stripper 710 of the sludge solvent removal means 70, illustrated in FIG. 7. The sludge stripper 710 is preferrably a vacuum type stripper, although an atmospheric type will function as well, wherein a flow of steam carries some water and substantially all solvent from the sludge. The water and solvent vapors exit the top of the stripper 710, pass through a condenser 712 where they are cooled and condensed and enter a stripper decanter 714. The decanter 714 separates the water and solvent by density and each component is pumped to its respective buffer tank, i.e., water is pumped to water buffer tank 444 and solvent is pumped to buffer tank 442 of the solvent recovery means 40. Stripped sludge plus water exit the bottom of the sludge stripper 710 and are introduced to the sludge dewatering means 80. A vacuum pump 725 acts to remove any air which has leaked into the various vessels within the system 70 and 75, including the decanter 714. The condensed solvent vapors, including water, are collected in a vacuum seal tank 726 and pumped to the buffer tank 444. The vacuum pump 725 is sealed and cooled with water which is recirculated from the vacuum seal tank 726 through a heat exchanger 727.

The slurry from the sand reslurry tank 630 flows to a sand slurry stripper 752 of the sand slurry solvent removal means 75. The stripper 752 is similar in construction and effect to the sludge stripper 710. Both are steam stripping columns. The stripper 752 is, however, preferrably operated under vacuum conditions, although an atmospheric stripper will function as well. As in the stripper 710, steam is injected into the stripper 752 and carries off solvent and some water from the sand. The stripped solvent and water vapors joins the stream of solvent and water vapors emerging from the stripper 710 and the components are condensed and separated. Stripped sand plus some water exit the bottom of the stripper 752 and are pumped to the sand dewatering means 85.

Figure 8:
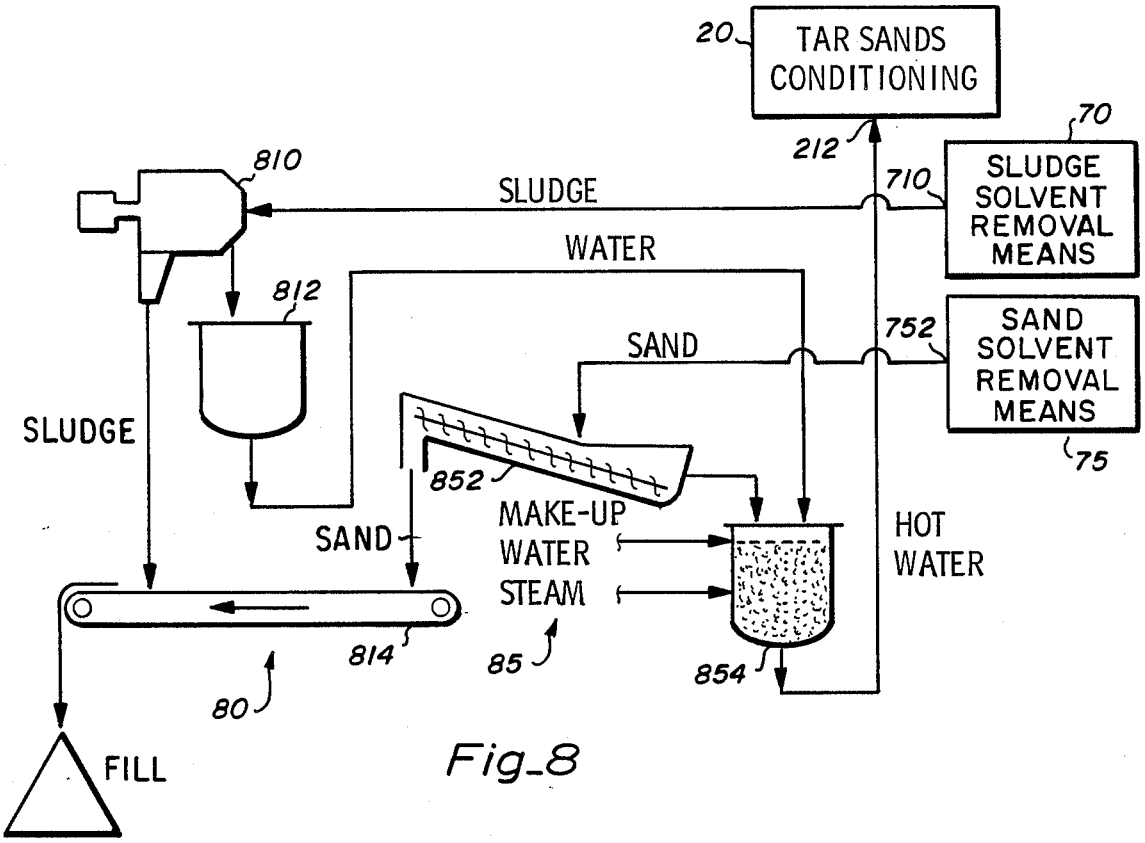
FIG. 8 is a diagram showing a detailed schematic implementation of the sand and sludge dewatering steps of FIG. 1.

Sludge from the stripper 710 is fed into a centrifuge 810 of the sludge dewatering means 80, illustrated in FIG. 8. Within the means 80, moisture is reduced to approximately 25 to 35 percent. Recovered water is held in a centrate receiver tank 812. Sludge from the centrifuge 810 is deposited on a tailings sand and sludge conveyor 814 and exits the dewatering means 80.

Within the sand dewatering means 85, also illustrated in FIG. 8, the sand and water enter a tailing sand dewaterer 852 having a screw dehydrator and being substantially similar to the sand washers 610 and 614. The action of the screw within the dewaterer 852 conveys the solid particles upward while allowing water to drain out in an opposite direction. The drained water is collected in an under flow tank 854 and is substantially free of solvent and bitumen oils. Make-up water may also be supplied to the tank 854, as is steam to heat the water, and contents thereof are pumped to the log washer conditioner 224 of the ore conditioning means 20 for reuse. Also, if it is desired to cool the sand, cool make-up water can be charged to the sand dewaterer 852 and heat from the sand can be transferred to the water for use in the log washer conditioner 224. Within the sand dewaterer 852, the water content of the sand is reduced to about twenty percent and the dewatered sand is conveyed out of the sand dewaterer 852 and falls onto the conveyor 814 whereby it is delivered to a storage point for use as fill.

It should be noted that various prior art apparatus may be used in the sludge dewatering means 80 and the sand dewatering means 85, such as vacuum belt filters, centrifugation, settling means, and combinations thereof. It is also to be noted that any such dewatering means may be utilized immediately after the conditioning stage 20 to dewater the slurry prior to its entry into the bitumen extraction and separation means 30. Lastly, it is to be noted that a plurality of pumps and piping (not shown) are necessary to interconnect the various elements of the process 10 and are used as known in the art.

Figures 7, 10:
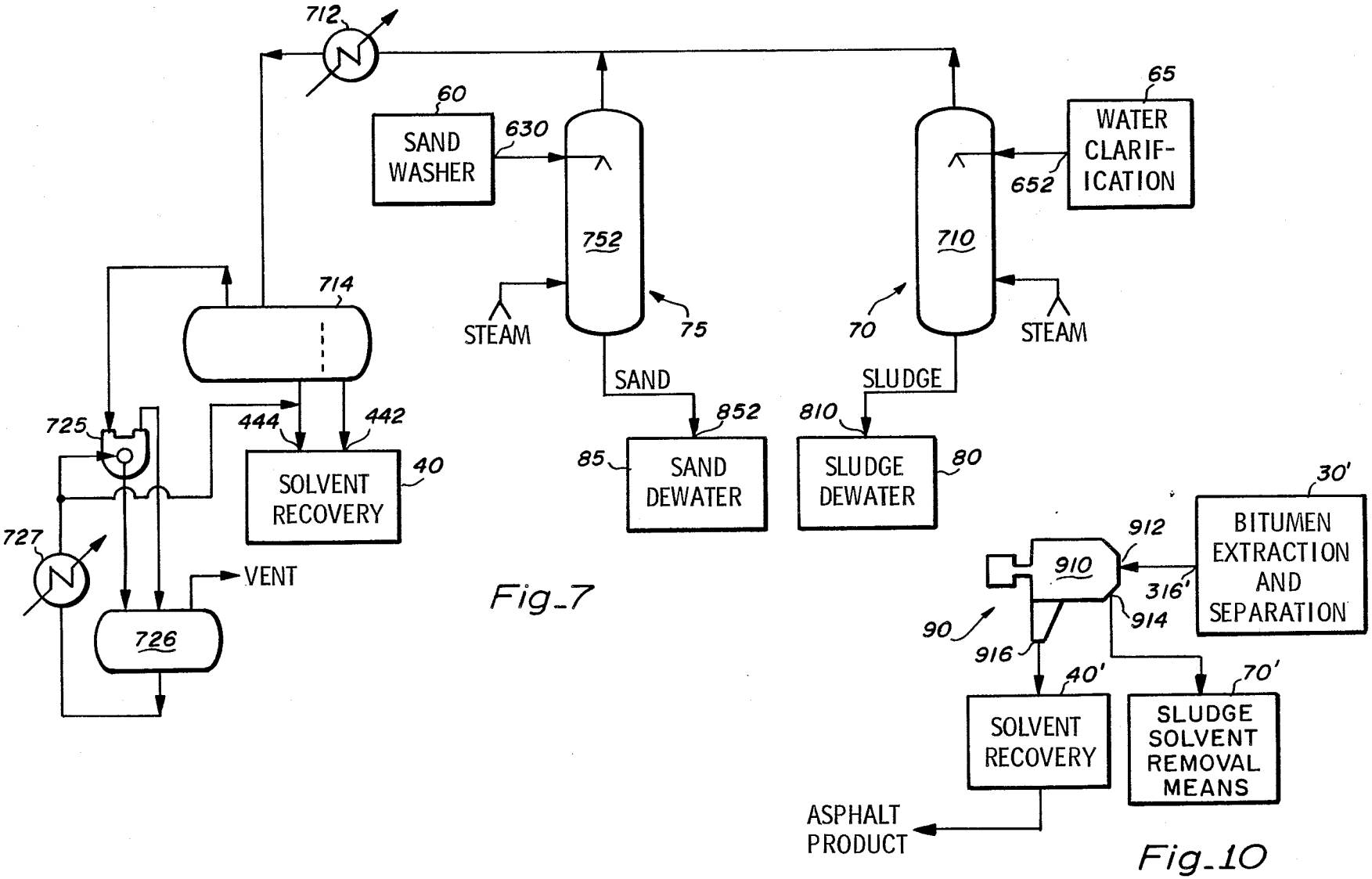
FIG. 7 is a diagram showing a detailed schematic implementation of the sand and sludge solvent removal steps of FIG. 1.
FIG. 10 is a diagram showing a detailed schematic illustration of the centrifuging step of the alternative embodiment of FIG. 9.
Figure 9:
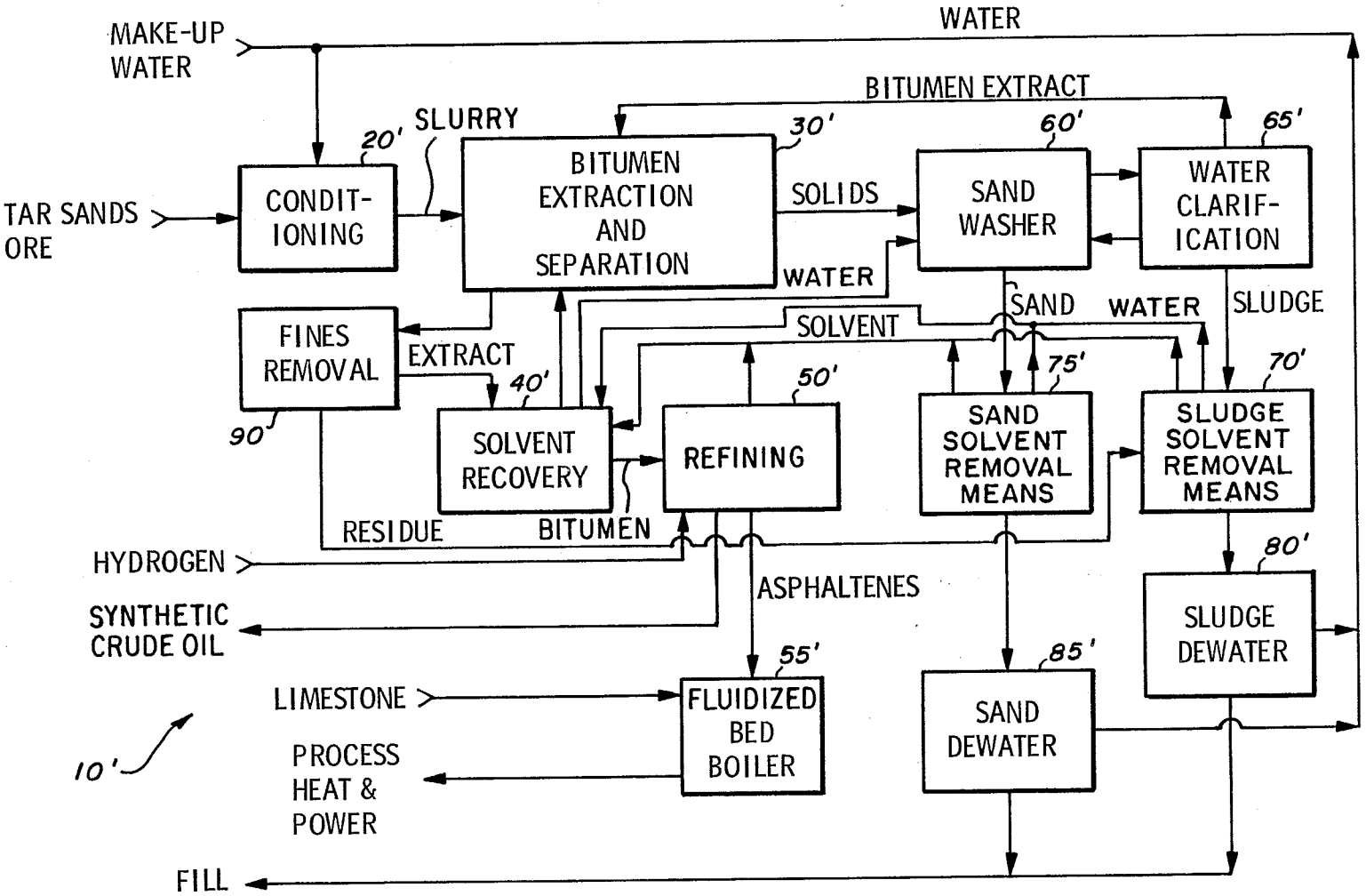
FIG. 9 is a schematic block diagram illustrating and alternative embodiment of the method of the present invention.

A first alternative of the process 10, illustrated in FIGS. 9 and 10 and designated by the general reference character 10' includes a preliminary fines removal means 90. The remaining process steps are identical with those of process 10, and are designated by the same reference numeral distinguished by a prime designation. The fines removal means 90 is interposed between the bitumen extraction and separation means 30' and the solvent recovery means 40' and can reduce the fines content of the bitumen oils to a range of one-half to two percent. A detailed implementation of the fines removal means 90 is shown in FIG. 10, and comprises a centrifuge 910 which receives a flow of bitumen extract at an inlet 912 from the extract outlet 316' of the bitumen extraction and separation means 30'. The centrifuge 910 includes a sludge outlet 914 and a clarified bitumen extract outlet 916. Sludge from the sludge outlet 914 is delivered to the sludge solvent removal means 70' wherein solvent is recovered. Bitumen extract which has been reduced in fines content may be delivered to the solvent recovery means 40'. For certain applications, a desired product of the process 10' may be a specification grade asphalt product. This can be obtained by drawing off a portion of the bitumen oils product exiting the solvent recovery means 40' and suitably processing it; e.g., with a topping column (not shown).

Figure 11:
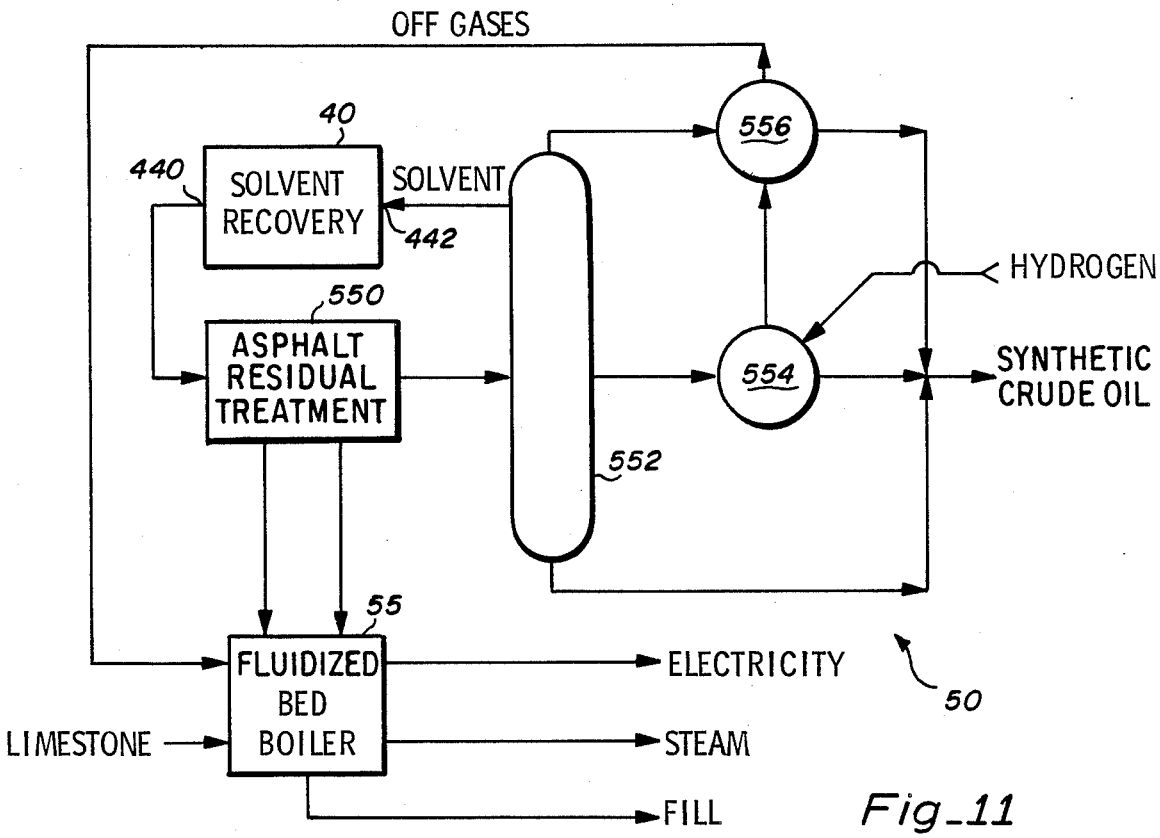
FIG. 11 is a detailed schematic illustration of an alternative refining step of FIG. 1.

FIG. 11 illustrates an alternative implementation of the refining means 50 of the process 10, and involves the deposition of carbon from the bitumen oils onto a catalyst in a process represented by block 550 and called an asphalt residual treatment. Typical processes and catalysts are well known in the art. The carbon is then separately burned off in a catalyst regenerator. The velocity of the air used in burning the carbon will aid in removing the fines fraction with the flue gases which enter the fluidized bed boiler means 55. Bitumen oils which have been reduced in fines and asphaltenes content by the process 550 are fed to a distillation means 552, which may comprise, for example, a distillation column. The column 552 separates the oils into various fractions such as a lower synthetic crude oil fraction, an intermediate naphtha fraction, a light solvent fraction, and a light fraction. The light solvent fraction may be charged to the solvent recovery means 40 for recycle. The naphtha fraction is hydrogenerated in a hydrogenation means 554 to stabilize the fraction and is then combined with the synthetic crude fraction as product. The light fraction comprising volatile hydrocarbons and off gases passes through stripper 556 which removes the off gases. The removed gases are burned in the fluidized bed boiler means 55, together with a supply of limestone to ensure sulphur capture and suppression of oxides of nitrogen. The remaining hydrocarbons from the light fraction are combined with the stabilized naphtha and synthetic crude oil fractions and exit the means 50 as high grade, synthetic crude oil.

Although the present invention has been described in terms of the presently preferred embodiment, it is to be understood that such disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

I claim:

1. A method of extracting bitumen oils from tar-sands ore comprising the steps of:

a. an initial conditioning step comprising crushing tar-sands ore to yield solid particles of a maximum size required by a log washer conditioner in a second conditioning step;

b. said second conditioning step comprising mixing said crushed solid particles with hot water, while excluding air and solvent therefrom to form a slurry of said solid particles and water, and agitating said slurry using a mechanical agitation means comprising said log washer conditioner;

c. a bitumen extraction step comprising dissolving a quantity of bitumen oils from said slurry by adding a quantity of bitumen extract and a solvent, and allowing said solid particles and said bitumen oils to contact said bitumen extract and said solvent in said slurry for a time period whereby substantially all of said bitumen oils dissolve in said solvent;

d. a bitumen separation step comprising separating said slurry into a bitumen extract phase comprising said bitumen oils, fines and water in said solvent and a wet solids component comprising sand, fines and water, using density separation means;

e. a solvent recovery step comprising stripping and recovering said solvent and water from said bitumen extract phase for reuse in the method, thereby producing said bitumen oils free of said solvent and water;

f. a sand washing and water clarification step comprising separating said wet solids component into a wet sand component, water, bitumen extract and a sludge component and recovering said water;

g. a sand solvent recovery step comprising removing said solvent from said wet sand component to yield said solvent, wet sand and water; and h. a sludge solvent recovery step comprising removing said solvent from said sludge component to yield said solvent, sludge and water.

2. The method of claim 1 wherein, the bitumen extraction and separation steps further comprise;

a. pumping said slurry into a first soak vessel together with a flow of said bitumen extract comprising said solvent with said bitumen oils, and agitating the slurry therein;

b. transferring the contents of said first soak vessel into a first sand separation vessel and allowing the contents to settle into layers in accordance with their densities;

c. drawing off a lower stream from said first sand separation vessel, pumping it into a second soak vessel and mixing therewith a volume of said solvent, and drawing off as an upper layer from said first sand separation vessel a stream of said bitumen extract;

d. drawing off the contents of said second soak vessel and transferring said contents to a second sand separation vessel; and e. drawing off from said second sand separation vessel a lower layer of said sand, fines and water from which substantially all said solvent and bitumen oils have been removed and drawing off as an upper layer a stream of said bitumen extract plus some of said fines and returning said stream of bitumen extract plus some fines to said first soak vessel to contact said slurry therein.

3. The method of claim 1 wherein, said log washer conditioner having a pair of rotating shafts, each shaft including a plurality of paddles attached thereto whereby submerged tar-sands in said slurry are abraided to condition said tar-sands and loosen the bitumen oils associated therewith.

4. The method of claim 3 wherein, said paddles are attached to said shafts at an angle of between twenty-five degrees forward and fifteen degrees backward.

5. The method of claim 2 wherein, the solvent recovery step further comprises separating said bitumen extract phase into a bitumen oil fraction, said solvent and a water fraction by;

a. charging said stream of said bitumen extract and said fines from said first sand separation vessel through a heat exchanger to raise the temperature to above the boiling point of said solvent;

b. flashing off said solvent and water vapors in a solvent flashing column;

c. introducing a remaining portion of said bitumen extract from which some of said solvent and water has been flashed off into a steam stripping column wherein a quantity of said solvent and water which remains is stripped off leaving pure bitumen oils; and d. separating, collecting and recycling said solvent and water removed by said flashing column and by said steam stripping column.

6. The method of claim 1 further including, a fines removal step wherein said fines are separated from said bitumen extract phase.

7. The method of claim 6 wherein, said fines are separated from said bitumen extract by centrifuging said bitumen extract prior to recovering said solvent therefrom.

8. The method of claim 1 wherein, the sand solvent recovery step further comprises passing said wet sand through a steam stripping column to separate said solvent from said wet sand.

9. The method of claim 8 wherein, the sludge solvent recovery step further comprises passing said sludge through a steam stripping column to separate said solvent and water from said sludge.

10. The method of claim 9 wherein, said solvent and water from said wet sand and said sludge is passed through a condenser to a decanter which separates the water and said solvent for recycling in the method.

11. The method of claim 1 wherein, said solvent is in a liquid state during the bitumen extraction and separation steps.

12. A method for extraction of bitumen oils from tar-sands ore comprising the steps of:

a. an initial conditioning step comprising crushing tar-sands ore to yield solid particles of a maximum size required by a log washer conditioner in a second conditioning step;

b. said second conditioning step comprising mixing said crushed solid particles with hot water, while excluding air and solvent therefrom to form a slurry of said solid particles and water, and agitating said slurry using a mechanical agitation means comprising said log washer conditioner;

c. a bitumen extraction step comprising dissolving a quantity of bitumen oils from said slurry by adding a quantity of bitumen extract and a solvent, and allowing said solid particles to contact said bitumen extract and said solvent in the absence of air while agitating said slurry;

d. a bitumen separation step comprising separating said slurry into a bitumen extract phase comprising said bitumen oils, fines and water in said solvent and a wet solids component comprising sand, fines and water, using density separation means;

e. a solvent recovery step comprising stripping and recovering said solvent and water from said bitumen extract phase for reuse in the method, thereby producing said bitumen oils free of said solvent and water;

f. a sand washing and water clarification step comprising separating said wet solids components into a wet sand component and a sludge component by a screw classifier and thickener-settler means and recovering water therefrom;

g. a sand solvent recovery step comprising steam stripping said sand component to extract further said solvent therefrom;

h. a sludge solvent recovery step comprising steam stripping said sludge component to extract further said solvent therefrom; and i. a sand and sludge dewatering step comprising dewatering said washed sand and said sludge from which said solvent has been stripped.

13. A method of extracting bitumen oils from tar-sands ore comprising the steps of:

a. an initial conditioning step comprising crushing tar-sands ore to yield solid particles of a maximum size required by a log washer conditioner in a second conditioning step;

b. said second conditioning step comprising mixing said crushed solid particles with hot water while excluding air and solvent therefrom to form a slurry of said solid particles and water, and agitating said slurry using said log washer conditioner whereby said solid particles are abraided to condition said solid particles and loosen the bitumen oils associated therewith without introduction of air, passing said slurry through a screening means to remove oversized rocks, and then passing said slurry through a slurrying tank;

c. a bitumen extraction step comprising taking said slurry from the second conditioning step and in the absence of air and air induced emulsions and dissolving a quantity of said bitumen oils from said slurry by adding a quantity of bitumen extract and a solvent, and allowing said solid particles and said bitumen oils to contact said bitumen extract and said solvent in said slurry for a time period whereby substantially all of said bitumen oils dissolve in said solvent;

d. a bitumen separation step comprising taking said slurry from the bitumen extraction step and in the absence of air and air induced emulsions, separating said slurry into a bitumen extracted phase comprising said bitumen oils, fines and water in said solvent and a wet solids component comprising sand, fines and water, using density separation means;

e. a solvent recovery step comprising stripping and recovering said solvent and water from said bitumen extract phase for reuse in the method, thereby producing said bitument oils free of said solvent sand water;

f. a sand washing and water clarification step comprising introducing said wet solids into a sand washing means, and introducing wash water into the means to substantially fill the sand washing means, said wash water and said sand flowing countercurrently within the means producing a washed wet sand component, collecting said wash water and fines exiting the sand washing means and substantially removing said fines from said wash water as a sludge;

g. a sand solvent recovery step comprising steam stripping said solvent from said sand component to yield said solvent and water for reuse in the method;

h. a sludge solvent recovery step comprising steam stripping said solvent from said sludge component to yield said solvent and water for reuse in the method; and i. a dewatering step comprising dewatering said washed sand and said sludge components to further reduce the water content to approximately twenty percent for the sand component and approximately thirty percent for the sludge component whereby said sand and sludge and suitable for fill, and collecting the removed water for reuse in the method.

14. The method of claim 13 wherein, said wash water exiting the sand washing means is pumped to a thickener-settler vessel and agitated, a flocculant is added to facilitate gravity settling of said fines as a sludge, clarified water is removed from a circumferential weir and recycled, and said bitumen extract phase is removed internally near the top of the thickener-settler vessel and recycled.

15. The method of claim 13 wherein, said sand from the sand solvent recovery step is passed through a tailing sand dewaterer such that water is separated from said sand and recycled to the additional conditioning step; and said sludge is passed through a centrifuge such that water is separated from said sludge and is recycled to the additional conditioning step.

* * * * *